US008139799B2

(12) United States Patent
Chalupper

(10) Patent No.: US 8,139,799 B2
(45) Date of Patent: Mar. 20, 2012

(54) HEARING APPARATUS WITH CONTROLLED INPUT CHANNELS AND CORRESPONDING METHOD

(75) Inventor: Josef Chalupper, Paunzhausen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1204 days.

(21) Appl. No.: 11/906,468

(22) Filed: Oct. 2, 2007

(65) Prior Publication Data

US 2008/0101636 A1 May 1, 2008

(30) Foreign Application Priority Data

Oct. 2, 2006 (DE) ..... 10 2006 046 703

(51) Int. Cl.
*H04R 25/00* (2006.01)

(52) U.S. Cl. ..... 381/312; 381/317; 381/318

(58) Field of Classification Search ..... 381/317, 381/318, 312
See application file for complete search history.

(56) References Cited

U.S. PATENT DOCUMENTS

| | | | | |
|---|---|---|---|---|
| 5,046,102 | A | 9/1991 | Zwicker et al. | |
| 6,154,552 | A | 11/2000 | Koroljow et al. | |
| 7,151,838 | B2 * | 12/2006 | Galler et al. | 381/312 |
| 2003/0059076 | A1 * | 3/2003 | Martin | 381/331 |
| 2004/0057593 | A1 | 3/2004 | Pedersen et al. | |
| 2005/0041824 | A1 * | 2/2005 | Arndt et al. | 381/313 |

FOREIGN PATENT DOCUMENTS

| | | | |
|---|---|---|---|
| DE | 10211364 | A1 | 10/2003 |
| DE | 10 2004 013 952 | A1 | 10/2005 |
| EP | 0 219 025 | B1 | 4/1987 |
| EP | 0989775 | A1 | 3/2000 |
| EP | 1443803 | A2 | 4/2004 |
| EP | 1484942 | A2 | 12/2004 |
| WO | 2005018279 | A1 | 2/2005 |

* cited by examiner

*Primary Examiner* — David Vu
*Assistant Examiner* — Brandon Fox

(57) ABSTRACT

The signal quality in a hearing apparatus and in particular in a hearing device featuring a plurality of input channels is to be improved. Provision is made for this purpose for a hearing apparatus with a plurality of input channel systems each for recording and preprocessing an input signal and for outputting a channel signal each and a central computing device for processing a plurality of channel signals of the input channel systems. At least one of the plurality of input channel systems can be controlled by the central computing device as a function of at least two of the plurality of channel signals. Local weighting or deactivation of input channel components can be performed by means of this feedback using central information from the computing device. The latter case additionally allows for power consumption to be reduced.

10 Claims, 3 Drawing Sheets

( Stand der Technik )

HEARING APPARATUS WITH CONTROLLED INPUT CHANNELS AND CORRESPONDING METHOD

CROSS REFERENCE TO RELATED APPLICATIONS

This application claims priority of German application No. 10 2006 046 703.5 filed Oct. 02, 2006, which is incorporated by reference herein in its entirety.

FIELD OF THE INVENTION

The present invention relates to a hearing apparatus with a plurality of input channel systems each for recording and preprocessing an input signal and for outputting a channel signal each and a central computing device for processing a plurality of channel signals of the input channel systems. The present invention further relates to a corresponding method for controlling a hearing apparatus with a plurality of input channels. The term hearing apparatus is understood here to refer in particular to a hearing device. However the term may also include other wearable and non-wearable acoustic devices having a plurality of input channels.

BACKGROUND OF THE INVENTION

Hearing devices are wearable hearing apparatuses which assist hard-of-hearing people. In order to accommodate numerous individual requirements, various types of hearing devices are available such as behind-the-ear (BTE hearing devices, in-the-ear hearing devices (ITE), conch hearing devices, and so on. The hearing devices listed as examples are worn on the outer ear or in the auditory canal. Bone conduction hearing aids, implantable or vibro-tactile hearing aids are also available on the market. The damaged ear is thus stimulated either mechanically or electrically.

The key components of hearing devices are principally an input converter, an amplifier and an output converter. The input converter is normally a sound receiver e.g. a microphone and/or an electromagnetic receiver, e.g. an induction loop. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording sound from the environment are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or earpiece 4, which outputs an acoustic signal. Sound is transmitted through a sound tube, which is fixed in the auditory canal by means of an otoplastic, to the device wearer's eardrum. Power for the hearing device and in particular for the signal processing unit 3 is supplied by means of a battery 5 which is also integrated in the hearing device housing 1.

Modern hearing devices normally feature a plurality of input channels. Input channels can be provided among other things through a microphone, a telephone loop, a directional microphone, an audio shoe and a digital input. Further additional input channels are expected to be added in future, for example for Bluetooth, wireless communication between hearing devices, etc. The optimum input channel depends in each case on the particular situation. If for example an induction loop is available in the vicinity of the hearing device wearer, the telephone loop would be the optimum input channel to select in this case.

To date the particular input channel has mostly had to be set manually. This frequently represents a major problem especially for older and very young hearing device wearers. A special mechanical solution, in which an audio shoe is attached to the hearing device, represents an improvement in this situation. Once the audio shoe has been attached, it is also selected as an input channel. A further example of automation is represented by the automatic activation of a telephone loop with the aid of a reed relay as soon as a magnetic near field from the telephone acts on the reed relay.

The publication EP 1 484 942 A2 further describes an automatic switchover between a telephone loop and a microphone with the aid of a signal classification. Patent specification EP 0 989 775 B1 further discloses a hearing device with a system for signal-quality monitoring. The monitoring system determines signal quality for the respective audio signal for example by means of a comparison with a specific reference value for the corresponding audio signal. The option is also specified to insert an identifier into the artificially-generated e.g. inductive, infrared or radio signals, which can be recorded by the monitoring system with little technical outlay and which indicates that the corresponding signal is of adequate quality. In each case signal quality is thereby determined from the signal itself. In principle this represents a solution to the problem described above, but problems arise for example when the telephone loop is being used when telephoning and loud background noise is introduced by means of the microphones, and it is only possible to determine whether the signal is a useful signal by means of the level on the corresponding channel.

The publication DE 102 11 364 A1 further describes the deactivation of signal processing devices of a hearing device. In order to reduce power consumption the hearing device is equipped with an internal or external hearing device signal source with a signal line for transferring a signal to a hearing device amplifier and a control system for activating and deactivating the hearing device signal source. A monitoring logic monitors the signal line and supplies a switching signal to the control system so that the hearing device signal source can be activated and deactivated on the basis of the switching signal. Self-deactivation is achieved through a reduction in the load impedance.

The publication EP 0 219 025 B1 further discloses a hearing device with a sound-recording microphone arrangement and an earpiece between which is inserted an arrangement comprising a plurality of voice frequency selector channels, which enables only the strongest channels in a multi-channel system to have an effect through continuous and reciprocal influencing of control signals of neighboring channels. The weaker channels are then completely suppressed. For this purpose an inhibition circuit is provided by means of which strong channels are emphasized and weaker channels are suppressed, taking account of signal strengths in neighboring channels.

The publication DE 10 2004 013 952 A1 further discloses a circuit arrangement having a plurality of filter stages of a filter bank and a plurality of resonator circuits. The circuit arrangement also contains a resonator control circuit for controlling or regulating the rating of the resonator circuits. Each of three resonator circuits are connected in series along a respective channel of the matrix-type arrangement such that a respective output of an upstream resonator circuit is connected with a respective input of a downstream resonator circuit. The resonator control circuit is connected communicatively with all resonator circuits. The rating of each individual resonator circuit is adjustable by means of the control circuit with the control circuit being configured such that it adjusts the rating of the resonator circuits as a function of the amplitude of an output signal of the last resonator circuit in a certain channel.

SUMMARY OF THE INVENTION

The object of the present invention is thus automatically to adjust signal quality better for a plurality of input channels.

This object is inventively achieved by means of a hearing apparatus having a plurality of input channel systems each for recording and preprocessing a separate input signal and for outputting a corresponding channel signal and a central computing device for processing a plurality of channel signals of the input channel systems, with at least one of the plurality of input channel systems being controllable by the central computing device as a function of at least two of the plurality of channel signals.

According to the invention a method is also provided for controlling a hearing apparatus having a plurality of input channels by recording and preprocessing a separate input signal in each of the plurality of input channels and outputting a corresponding channel signal from each of the plurality of input channels, and by varying at least one of the channel signals of the plurality of input channels as a function of at least two of the plurality of channel signals of the plurality of input channels.

It is thus advantageously achieved that not only one signal, but rather all or a plurality of signals, can be taken into account for controlling the input channels. Signal quality can thus be improved markedly.

Preferably at least one input channel system or at least one component thereof can be deactivated by the central computing device as a function of the plurality of channel signals. It can thus be achieved that only those components of the input channels that make a significant contribution to the useful signal are activated and consume power.

According to a further advantageous embodiment each channel signal is weighted by the central computing device as a function of the plurality of channel signals. A frequency- and time-specific weighting of the input channels can thus be performed taking account of the reciprocal action of the individual channels on one another.

A rating of each of the channel signals can furthermore be determined by the central computing device or a rating of the respective channel signal can be determined by each of the plurality of input channel systems, such that the ratings for controlling the at least one input channel system can be used. Thus for instance classification results, signal-to-noise ratios, speaker verifications and modulation spectra can be incorporated into the controlling of input channels by means of a corresponding rating value.

BRIEF DESCRIPTION OF THE DRAWINGS

The present invention is now described in more detail with reference to the appended drawings, in which.

DETAILED DESCRIPTION OF THE INVENTION

The exemplary embodiments shown in more detail below represent preferred embodiments of the present invention.

Figure 1:
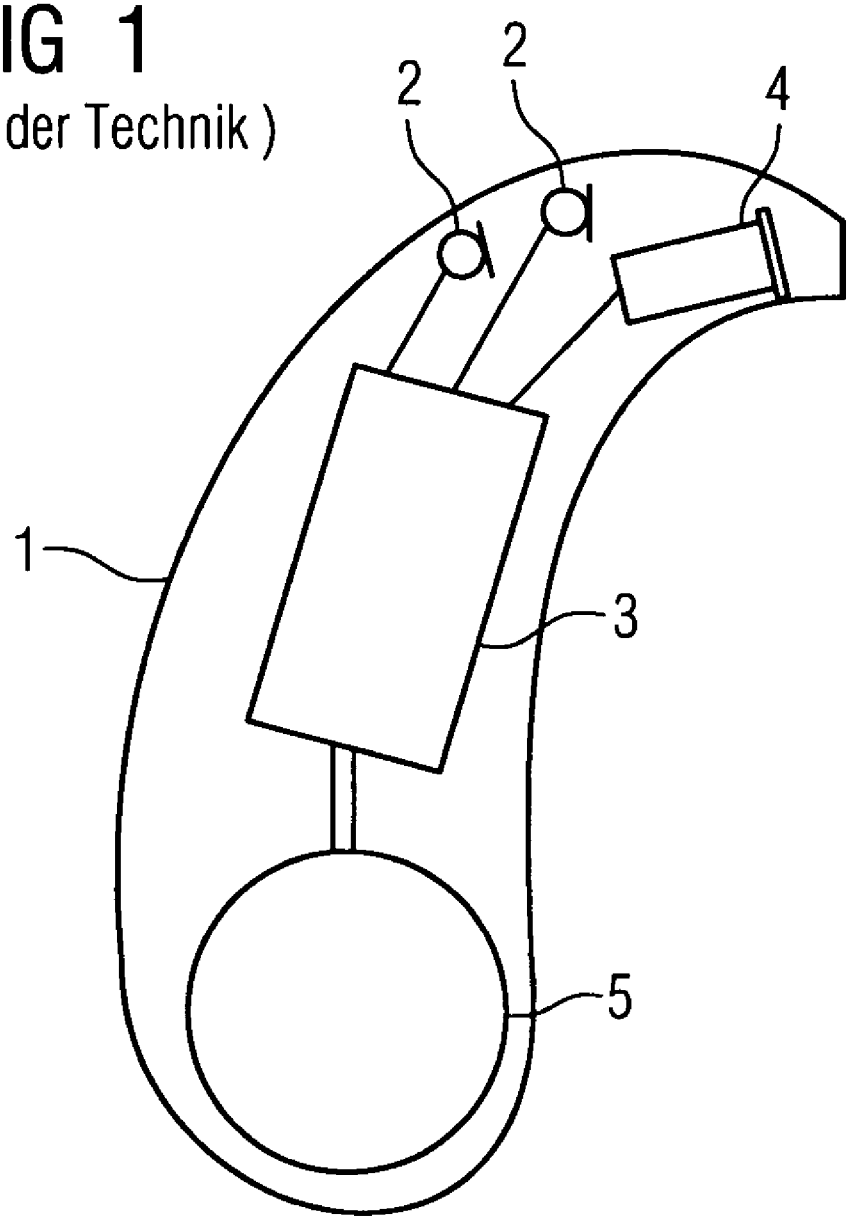
FIG. 1 shows a schematic configuration of a behind-the-ear hearing device.
Figure 2:
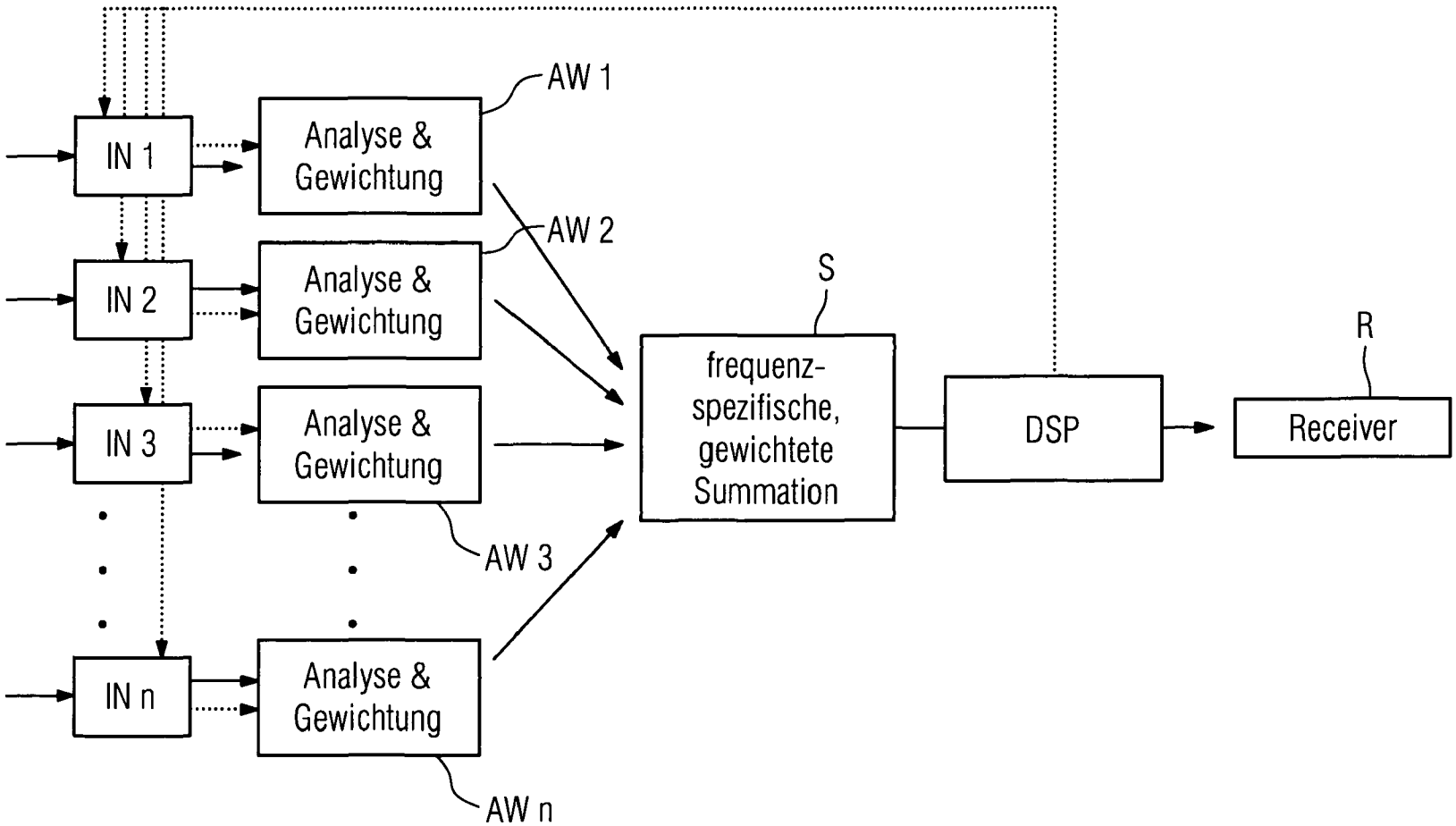
FIG. 2 shows a block diagram of the basic signal processing of a hearing device according to the invention.

The basic block diagram of a hearing device reproduced in FIG. 2 shows a plurality of input channels IN1, IN2, IN3, . . . , INn. Connected to each is a corresponding preprocessing unit AW1, AW2, AW3, . . . , AWn for analyzing and weighting the output signals from the input channels IN1, IN2, IN3, . . . , INn. The corresponding audio signals are indicated by continuous lines or arrows.

The output signals from the preprocessing units AW1 to AWn are added together in a subsequent summation system S according to frequency and weighting. The resulting summary signal is analyzed and processed further in a digital signal processor DSP. The output signal from the digital signal processor DSP is an audio signal which is forwarded to the earpiece or receiver R. From the summary signal the digital signal processor DSP also obtains control signals that are fed back to the input channel systems IN1 to INn and/or the preprocessing units AW1 to AWn. In the present example the fed-back control signals, which are indicated by dotted lines, are forwarded first to the corresponding input channel system IN1 to INn and thence to the respective preprocessing unit AW1 to AWn.

Figure 3:
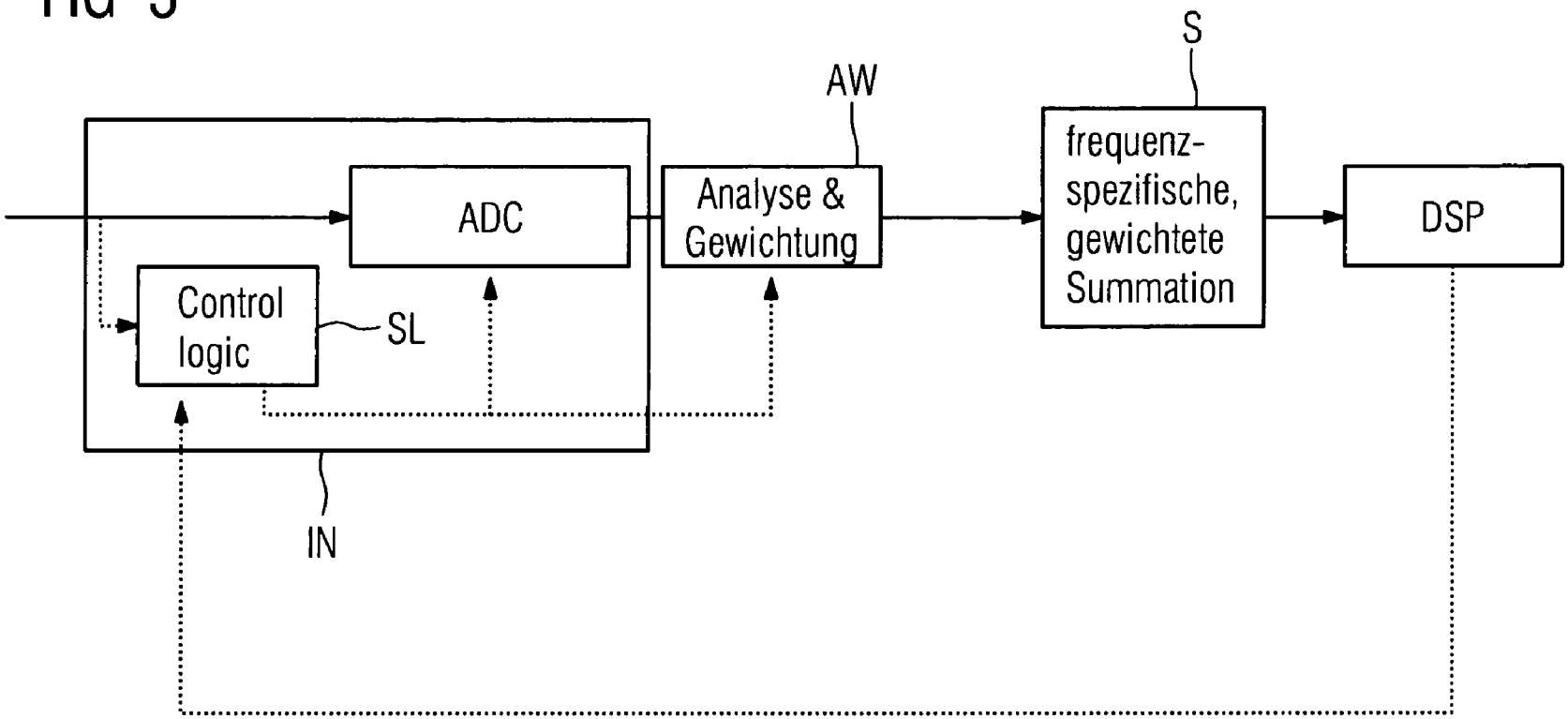
FIG. 3 shows a block diagram of an input channel from FIG. 1 in detail.

FIG. 3 represents the signal flow in an input channel in detail up to the digital signal processor DSP. In this example the input channel system IN comprises an AD converter ADC, which may also include additional signal preprocessing. The input channel system IN also features a control logic SL, which may for example cause the AD converter ADC to deactivate.

As shown in FIG. 3 the audio signal is transmitted after the input channel system IN by means of an analysis and weighting unit AW to the summation circuit S and then on to the digital signal processor DSP. The digital signal processor feeds back a control signal to the control logic SL of the input channel system IN as a function of the summation signal. Since the control logic SL in the example chosen also triggers the analysis and weighting unit AW it is possible to deactivate both the ADC and/or AW units as a function of the summation signal by means of the digital signal processor DSP. Alternatively the control logic of the analysis and weighting unit AW can send a weighting signal or a corresponding control signal as a function of the feedback signal. In the event that one of the components SL, ADC and AW is deactivated, the control logic SL features an additional input through which a control signal, which is included for example in the input audio signal, can be recorded. It is thus possible for example to "reawaken" the control logic SL and/or the components ADC and/or AW that it has deactivated.

The mode of operation of the signal processing units shown in FIGS. 2 and 3 will be described in detail below. Of particular importance is the feedback from the digital signal processor DSP, which represents the central processing unit of the hearing device, to the peripheral input channels. This means that the decision to assign a particular weighting to a particular channel or to deactivate a particular channel is not purely a bottom-up process (e.g. threshold logic) but is also a top-down process.

A frequency- and time-specific weighting of the input channels is performed on the DSP on the one hand with the aid of the information that is only available in the DSP (not on the input channel) and on the other hand with the aid of a combination of information via individual channels. This method of determining weightings as a function of a plurality of input channels and central information contrasts with the determination of weightings purely on the basis of a threshold logic, which can only evaluate information for the individual corresponding input channel.

A time-variable measure for the rating of the input channel is calculated in each frequency band and input channel. According to its rating each input channel is weighted in a time-dependent manner and "mixed" with the other input channels (summated). It is then possible to determine the "best channel" by means of a comparison of the ratings for the various channels.

The information evaluated centrally to calculate the rating includes for example a classification result. Consequently the same input channels are always used in particular situations. Thus for example it is unlikely that a directional microphone or a telephone loop would be used in a "music" hearing situation. The signal-to-noise ratio (SNR) can provide more information for the calculation of the rating. The smaller the SNR, the lower the rating.

Speaker verification can also be drawn upon to determine the rating. If a preferred speaker is recognized, which can be individually trained, this increases the rating. Information from the modulation spectrum can also contribute to the calculation of a rating. The stronger the modulations, the higher the corresponding rating.

A time-dependent weighting is calculated centrally in the digital signal processor DSP. The central decisions are combined with the peripheral decisions (e.g. threshold criterion) in the control logic SL of each input channel.

The primary objective in particular in hearing devices is to save power. This can be achieved for example by determining the aforementioned channel-specific information by means of a broadband signal analysis. Thus the need for a filter bank, which consumes a significant amount of power, becomes obsolete.

A further possibility to save power consists in deactivating input channels or components thereof that do not make a significant contribution to the useful signal. For example a channel or a component thereof can be deactivated unless a predetermined threshold is exceeded. Otherwise, if the threshold is exceeded, the corresponding signal is simply allowed to pass through.

In accordance with the present example the deactivation of unrequired components such as AD converter, signal analysis unit, demodulation unit etc. can be performed by the control logic SL. For this purpose a mechanical logic may be employed, which can be performed for example in the plug-in mechanism of an audio shoe. When plugging in the audio shoe for example the AD converter and the signal analysis unit are then activated. Alternatively or additionally the control logic may feature an analogous threshold logic by means of which it is possible only to activate those channels the signals of which exceed a certain amplitude.

However the control logic for deactivating certain components can also include a classification control. In this way it is possible always to use the same input channels in certain situations.

Channels and/or components thereof can only be deactivated if and to the extent that reactivation is possible at any time. An activation code (wake-up bit) can be used for this purpose in the audio signal or in the control signal of the DSP.

The time-dependent weighting avoids an abrupt switchover and instead enables switching to take place between the various channels along the time or frequency axis. Thus for example the switch can be restricted at a specific point in time to just one frequency band, with a cross-fading taking place in this frequency band from a first source i.e. from a first input channel to a second source i.e. a second input channel.

Optimal sound and/or optimized voice comprehension can thus advantageously be achieved at all times and fully automatically by means of the inventive selection of the input channels. The operation of the input channels according to the invention furthermore allows for full compatibility with future external signal sources. A further advantage is the low power consumption that can be achieved through the automatic deactivation of components. In conclusion the inventive control and/or regulation, especially through the signal analysis with SNR assessment and speaker verification, allow for an individually-optimized input channel to be specified.

The invention claimed is:

1. A hearing apparatus for automatically selecting an optimal input channel from a plurality of input channels, comprising:

a plurality of input channels for receiving audio input signals;

a plurality of preprocessing units each connected respectively to one of the plurality of input channels for separately analyzing and weighing the audio input signals received by the input channels and outputting separate channel signals therefrom;

a summation system connected to the plurality of preprocessing units for generating a summary signal from the separate channel signals; and a central computing device for processing the signal for transmitting to an output converter and for generating a feedback control signal for selecting one or more optimal input channels by controlling activation and deactivation of one or more of the input channels and one or more of the respective preprocessing units, wherein the feedback control signal is a function of at least two of the channel signals.

2. The hearing apparatus as claimed in claim 1, wherein certain input channels are deactivated by the central computing device such that the input channels that remain active have been determined to be the optimal input channels.

3. The hearing apparatus as claimed in claim 1, wherein each of the separate channel signals is weighted by the central computing device as a function of the plurality of channel signals.

4. The hearing apparatus as claimed in claim 1, wherein a plurality of ratings are determined for the channel signals and are used for controlling at least one of the input channels, wherein the ratings are based on a rating value corresponding to one or more of classification results, signal-to-noise ratios, speaker verifications, and modulation spectra.

5. The hearing apparatus as claimed in claim 1, wherein activation and deactivation of input channels comprises cross-fading to avoid abrupt switchover and enables switching to take place between the various channels along a time or frequency axis.

6. A method for controlling a hearing apparatus to automatically select an optimal input channel from a plurality of input channels, the method comprising:

receiving audio input signals via a plurality of input channels;

preprocessing the audio input signals via a plurality of preprocessing units each connected respectively to one of the plurality of input channels and outputting separate channel signals therefrom;

generating a summary signal from the separate channel signals via a summation system connected to the plurality of preprocessing units;

processing the summary signal for transmitting to an output converter; and generating a feedback control signal for selecting one or more optimal input channels by controlling activation and deactivation of one or more of the input channels, wherein the feedback control signal is a function of at least two of the channel signal.

7. The method as claimed in claim 6, wherein certain input channels are deactivated as a function of the plurality of channel signals such that the input channels that remain active have been determined to be the optimal input channels.

8. The method as claimed in claim 6, wherein each of the separate channel signals is weighted as a function of the plurality of channel signals.

9. The method as claimed in claim 6, wherein a plurality of ratings are determined for the channel signals and are used for controlling at least one of the input channel signals wherein the ratings are based on a rating value corresponding to one or more of classification results, signal-to-noise ratios, speaker verifications, and modulation spectra.

10. The method as claimed in claim 6, wherein activation and deactivation of input channels comprises cross-fading to avoid abrupt switchover and enables switching to take place between the various channels along a time or frequency axis.

* * * * *